US006561154B2

(12) United States Patent
Ito et al.

(10) Patent No.: US 6,561,154 B2
(45) Date of Patent: May 13, 2003

(54) ENGINE HEAD COVER STRUCTURE

(75) Inventors: Keita Ito, Wako (JP); Takeshi Maeda, Wako (JP); Yasutake Ryu, Wako (JP); Takao Nishida, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,167

(22) Filed: Oct. 29, 2001

(65) Prior Publication Data

US 2002/0066433 A1 Jun. 6, 2002

(30) Foreign Application Priority Data

Oct. 30, 2000 (JP) ..... 2000-329935

(51) Int. Cl.[7] ..... F01M 3/04

(52) U.S. Cl. ..... 123/195 C; 123/196 M; 123/572

(58) Field of Search ..... 123/195 R, 572, 123/195 C, 196 M, 41.86

(56) References Cited

U.S. PATENT DOCUMENTS 4,597,372 A * 7/1986 Furukawa ..... 123/572
6,021,766 A * 2/2000 Maeda et al. ..... 123/573
6,029,638 A * 2/2000 Funai et al. ..... 123/572
6,202,613 B1 * 3/2001 Nagai ..... 123/90.34
6,412,478 B1 * 7/2002 Ruehlow et al. ..... 123/572
6,484,679 B2 * 11/2002 Ito et al. ..... 123/90.31
2002/0023613 A1 * 2/2002 Ito et al. ..... 123/196 R

FOREIGN PATENT DOCUMENTS

JP 11-125107 5/1999
JP 148333 * 6/1999 ..... F01M/13/00
JP 210437 * 8/1999 ..... F01M/13/00

* cited by examiner

*Primary Examiner*—Henry C. Yuen
*Assistant Examiner*—Hai Huynh
(74) *Attorney, Agent, or Firm*—Armstrong, Westerman & Hattori, LLP

(57) ABSTRACT

An engine head cover structure has a head cover joined to the upper end of a cylinder head so as to define a valve operation chamber therebetween. The head cover includes therein an oil recovery chamber to which oil resided in the valve operation chamber is recovered by suction and a breather chamber that removes blowby gas from the valve operation chamber being provided in the head cover. The breather chamber is defined between a partition plate mounted on an inner wall of the head cover via clips and a surface of the roof of the head cover, and the oil recovery chamber is defined between the partition plate and a partition body welded thereto. It is thus possible to form the oil recovery chamber and the breather chamber without splitting the roof of the head cover, thereby making inspection of the joint for oil tightness unnecessary.

4 Claims, 14 Drawing Sheets

UPSIDE-DOWN STATE

LAID-SIDEWAYS TATE

ENGINE HEAD COVER STRUCTURE

BACKGROUND OF THE INVENTION

1. Field of the Invention

The present invention relates to handheld type four-cycle engines, which are mainly used as a power source for machines for portable operation such as trimmers. More particularly, it relates to improvement of an engine head cover structure in which a head cover is joined to the upper end of a cylinder head so as to define a valve operation chamber between the cylinder head and the head cover, and in the head cover are provided an oil recovery chamber which recovers by suction oil resided in the valve operation chamber, and a breather chamber which removes blowby gas from the valve operation chamber.

2. Description of the Prior Art

Such an engine head cover structure is already known as disclosed in, for example, Japanese Patent Application Laid-open No. 11-125107.

In the engine head cover structure disclosed in the above-mentioned publication, the roof of the head cover is split into upper and lower walls so as to define an oil recovery chamber therebetween, and a breather chamber is defined between a partition plate mounted on an inner wall of the head cover and a surface of the roof of the head cover.

Such an arrangement in which the roof of the head cover is split in order to provide an oil recovery chamber requires an oil-tight joint around the whole periphery of the split roof in order to prevent oil leakage from the oil recovery chamber to the outside of the head cover. It is therefore necessary to inspect the joint for oil-tightness, which is a barrier to reducing the production cost.

SUMMARY OF THE INVENTION

The present invention has been carried out in view of the abovementioned circumstances, and it is an object of the present invention to provide an engine head cover structure that allows an oil recovery chamber and a breather chamber to be formed without splitting the roof of the head cover and makes inspecting the joint for oil tightness unnecessary thus contributing to a reduction in the production cost.

In accordance with a first characteristic of the present invention, in order to achieve the above-mentioned object, there is proposed an engine head cover structure having a head cover joined to the upper end of a cylinder head so as to define a valve operation chamber therebetween, an oil recovery chamber to which oil resided in the valve operation chamber is recovered by suction and a breather chamber that removes blowby gas from the valve operation chamber, wherein the breather chamber is defined between a partition plate mounted on an inner wall of the head cover and a surface of the roof of the head cover, and the oil recovery chamber is formed integrally with the partition plate.

The above-mentioned valve operation chamber corresponds to a second valve operation chamber 21*b* of an embodiment of the present invention described below.

In accordance with the above-mentioned first characteristic, the oil recovery chamber and the breather chamber can be provided in the head cover without splitting the roof of the head cover, and moreover, both the breather chamber and the oil recovery chamber can be arranged within the head cover. As a result, even if there is some oil leakage from the two chambers, the oil merely returns to the valve operation chamber and does not cause any problem. It is unnecessary to inspect the peripheries of the two chambers for oil tightness, and it is thus possible to reduce the production cost.

Furthermore, in accordance with a second characteristic of the present invention, in addition to the above-mentioned first characteristic, there is proposed an engine head cover structure wherein the oil recovery chamber is defined between the surface of one side of the partition plate and a partition body welded thereto.

In accordance with the second characteristic, the partition body can be welded to the partition plate prior to mounting the partition plate on the head cover, and it is therefore possible to easily form the oil recovery chamber using the partition plate.

Furthermore, in accordance with a third characteristic of the present invention, in addition to the above-mentioned second characteristic, there is proposed an engine head cover structure wherein a first oil draw-up pipe that opens in the vicinity of the base of the valve operation chamber while communicating with the oil recovery chamber is formed integrally with one of the partition plate and the partition body, and a second oil draw-up pipe that opens in the vicinity of the roof of the head cover while communicating with the oil recovery chamber is formed integrally with the other one of the partition plate and the partition body.

In accordance with the above-mentioned third characteristic, the oil resided in the valve operation chamber can be recovered to the oil recovery chamber by means of the first and second oil draw-up pipes regardless of whether the operational position of the engine is upright or upside down. Moreover, since the first and second oil draw-up pipes are individually formed with one or the other of the partition plate and the partition body, the first and second oil draw-up pipes can be formed easily.

The above-mentioned objects, other objects, characteristics and advantages of the present invention will become apparent from an explanation of a preferable embodiment which will be described in detail below by reference to the appended drawings.

DESCRIPTION OF PREFERRED EMBODIMENT

An embodiment of the present invention is explained below by reference to the appended drawings.

Figure 1:
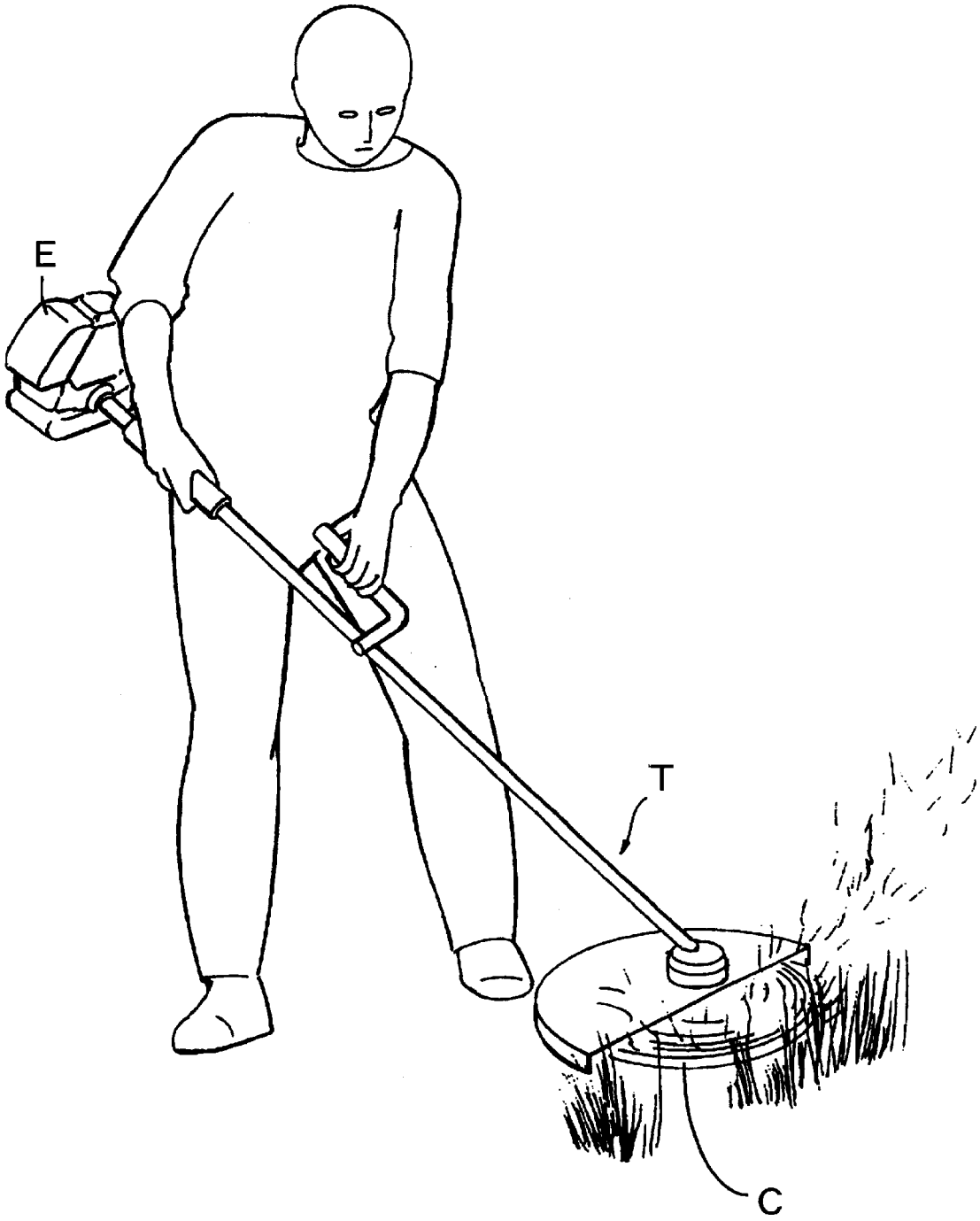
FIG. 1 is an oblique view showing one embodiment of the handheld type four-cycle engine of the present invention in practical use.

As shown in FIG. 1, a handheld type four-cycle engine E is attached as a source of power to the drive section of, for example, a powered trimmer T. Since the powered trimmer T is used in a manner in which a cutter C is positioned so as to face in various directions according to the operational conditions, the engine E is also tilted to a large extent or turned upside-down as a result and the operational position is changeable.

Figure 2:
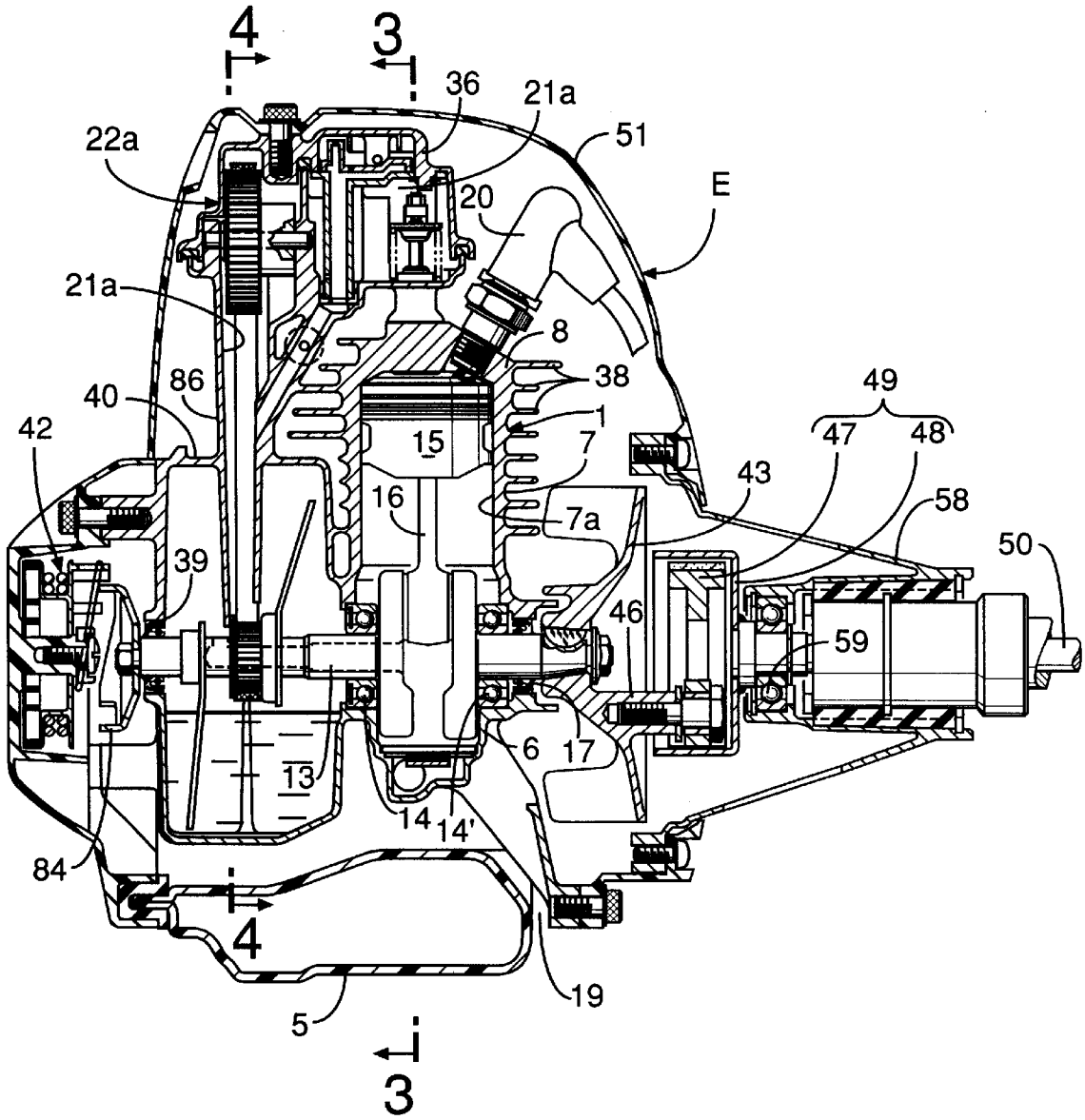
FIG. 2 is a longitudinal side view of the above-mentioned four-cycle engine.
Figure 3:
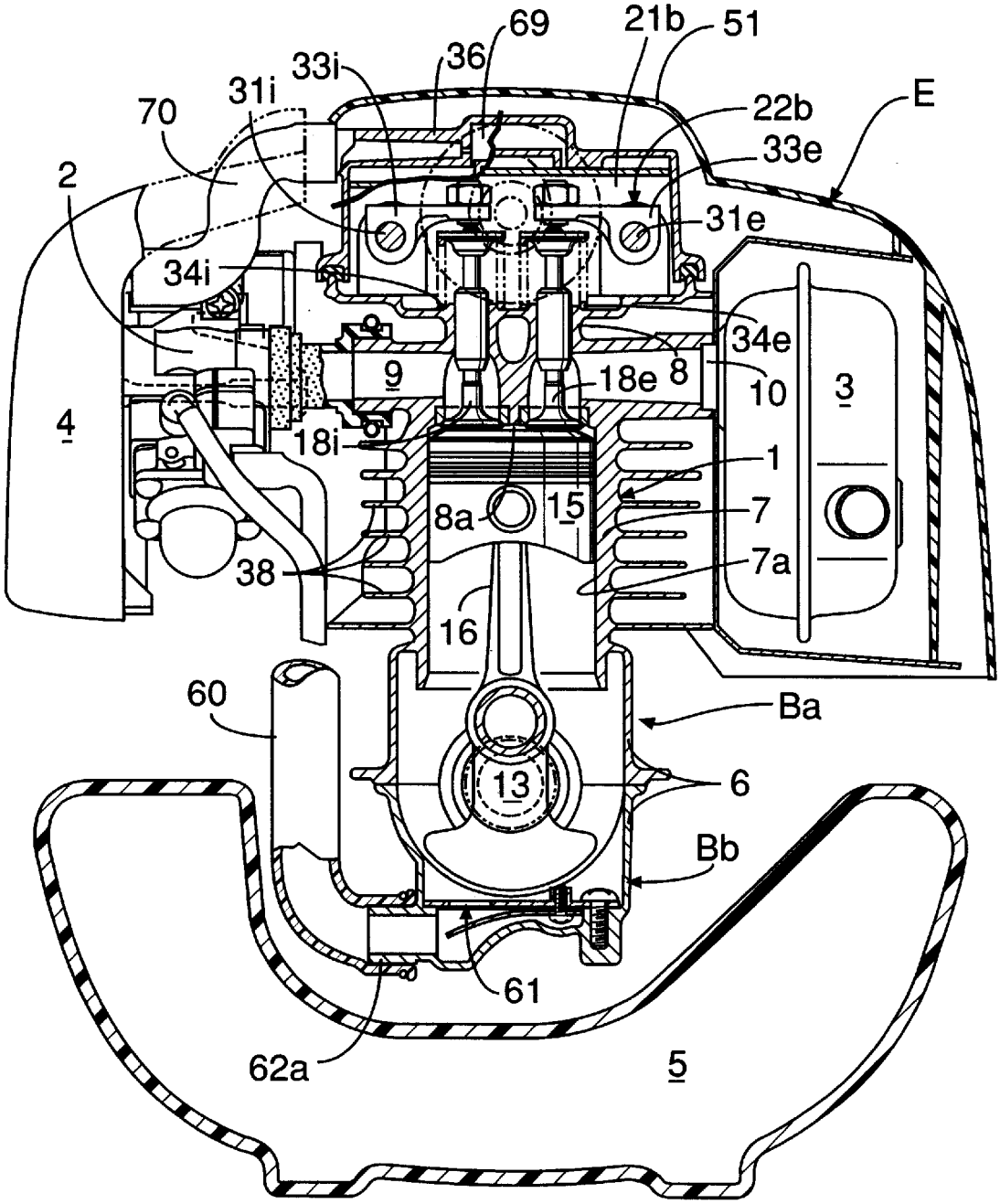
FIG. 3 is a cross-sectional view at line 3—3 in FIG. 2.

Firstly, the external structure of the handheld type four-cycle engine E is explained by reference to FIGS. 2 and 3.

Attached to the front and back of an engine main body 10 the abovementioned handheld type four-cycle engine E are a carburetor 2 and an exhaust muffler 3 respectively, and an air cleaner 4 is attached to the inlet of the carburetor 2. A fuel tank 5 made of a synthetic resin is mounted on the lower face of the engine main body 1. Opposite ends of a crankshaft 13 project outside the engine main body 1 and an oil tank 40 adjoining one side of the engine main body 1, and a recoil type starter 42 that can be operatively connected to a driven member 84 that is fixed to one end of the crankshaft 13 is mounted on the outside face of the oil tank 40.

Fixed to the other end of the crankshaft 13 is a cooling fan 43 that also serves as a flywheel. A plurality of fitting bosses 46 (one thereof is shown in FIG. 2) are formed on the outside face of the cooling fan 43, and a centrifugal shoe 47 is axially supported on each of the fitting bosses 46 in a swingable manner. These centrifugal shoes 47, together with a clutch drum 48 fixed to a drive shaft 50 which will be described below, form a centrifugal clutch 49 and when the rotational rate of the crankshaft 13 exceeds a predetermined value the centrifugal shoes 47 are pressed onto the inner periphery of the clutch drum 48 due to the centrifugal force of the shoes 47, thereby transmitting the output torque of the crankshaft 13 to the drive shaft 50. The cooling fan 43 has a larger diameter than that of the centrifugal clutch 49.

An engine cover 51 covering the engine main body 1 and its attachments except the fuel tank 5 is fixed at appropriate positions to the engine main body 1, and a cooling air inlet 19 is provided between the engine cover 51 and the fuel tank 5. Rotation of the cooling fan 43 therefore takes in outside air through the cooling air inlet 19 and supplies it for cooling each part of the engine E.

Fixed to the engine cover 51 is a frustoconical bearing holder 58 that is arranged coaxially with the crankshaft 13, and the bearing holder 58 supports, via a bearing 59, the drive shaft 50 that rotates the cutter C.

Since the oil tank 40 and the starter 42 are arranged on one side of the engine main body 1 and the cooling fan 43 and the centrifugal clutch 49 are arranged on the other side thereof, the weight balance of the engine E in the right and left directions is improved and the center of gravity of the engine E can be made closer to the central part of the engine main body 1, thereby enhancing the handling performance of the engine E.

Furthermore, since the cooling fan 43 which has a larger diameter than that of the centrifugal shoe 47 is fixed to the crankshaft 13 between the engine main body 1 and the centrifugal shoe 47, it is possible to minimize any increase in the dimensions of the engine E due to the cooling fan 43.

The structures of the engine main body 1 and the oil tank 40 are now explained below by reference to FIGS. 2 to 6 and 10 and 11.

In FIGS. 2 to 5 the engine main body 1 includes a crankcase 6 having a crank chamber 6*a*, a cylinder block 7 having one cylinder bore 7*a*, and a cylinder head 8 having a combustion chamber 8*a* and intake and exhaust ports 9 and 10 that open into the combustion chamber 8*a*, and a large number of cooling fins 38 are formed on the outer peripheries of the cylinder block 7 and the cylinder head 8.

The crankshaft 13 housed in the crank chamber 6*a* is supported in the left and right side walls of the crankcase 6 via ball bearings 14 and 14'. In this case, the left-hand ball bearing 14 is equipped with a seal, and an oil seal 17 is provided so as to adjoin the outside of the right-hand ball bearing 14'. A piston 15 fitted in the cylinder bore 7*a* is connected to the crankshaft 13 via a connecting rod 16 in a conventional and general manner.

The oil tank 40 is provided so as to be integrally formed with the left-hand wall of the crankcase 6 and is arranged so that the end of the crankshaft 13 on the sealed ball bearing 14 side runs through the oil tank 40. An oil seal 39 through which the crankshaft 13 runs is fitted in the outside wall of the oil tank 40.

A belt guide tube 86 having a flattened cross-section is provided integrally with the roof of the oil tank 40, the belt guide tube 86 running vertically through the roof of the oil tank 40 and having open upper and lower ends. The lower end of the belt guide tube 86 extends toward the vicinity of the crankshaft 13 within the oil tank 40, and the upper end is provided integrally with the cylinder head 8 so as to share a dividing wall 85 with the cylinder head 8. A continuous ring-shaped sealing bead 87 is formed around the periphery of the upper end of the belt guide tube 86 and the cylinder head 8, and the dividing wall 85 projects above the sealing bead 87.

Figure 6:
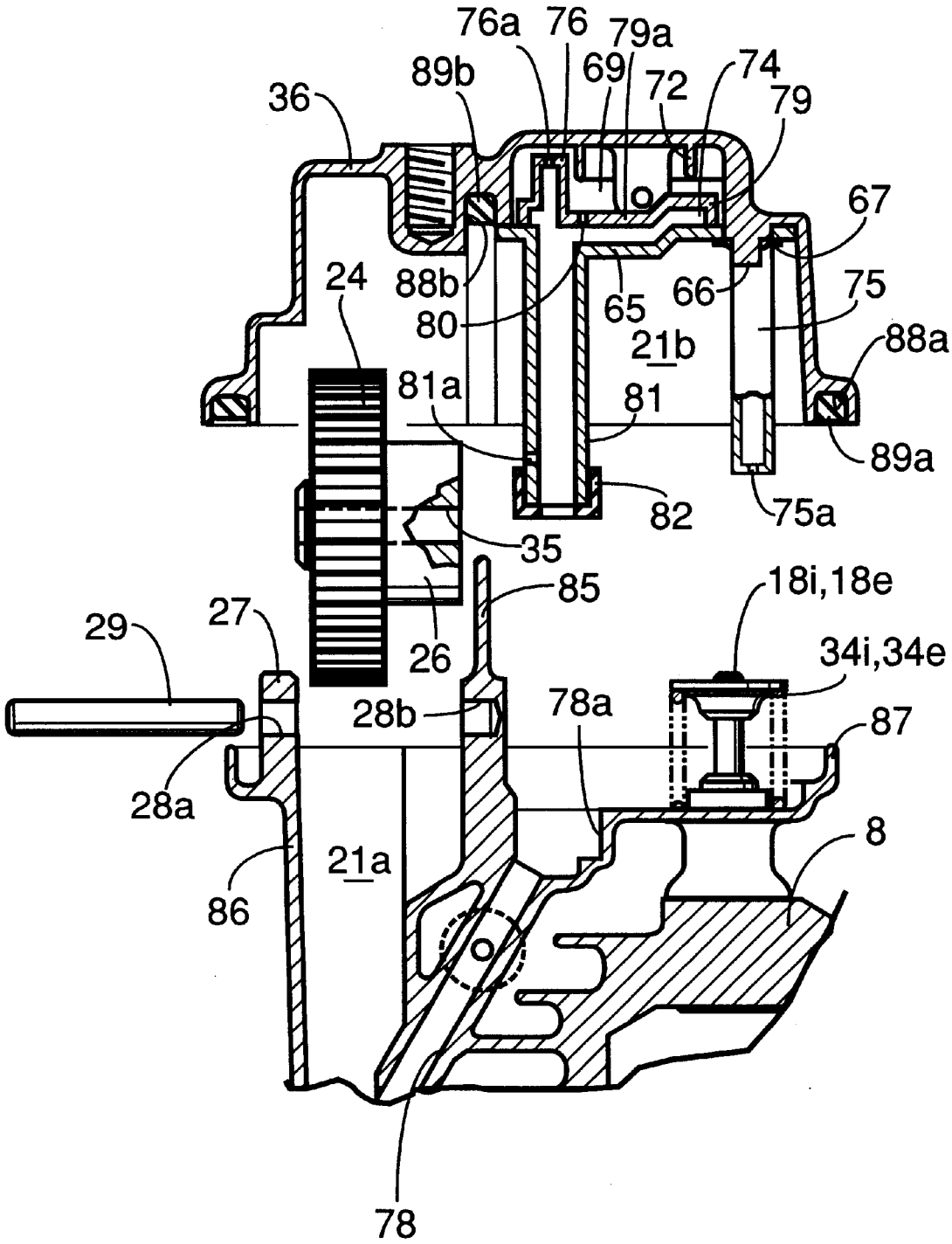
FIG. 6 is an exploded view of an essential part of FIG. 5.
Figure 7:
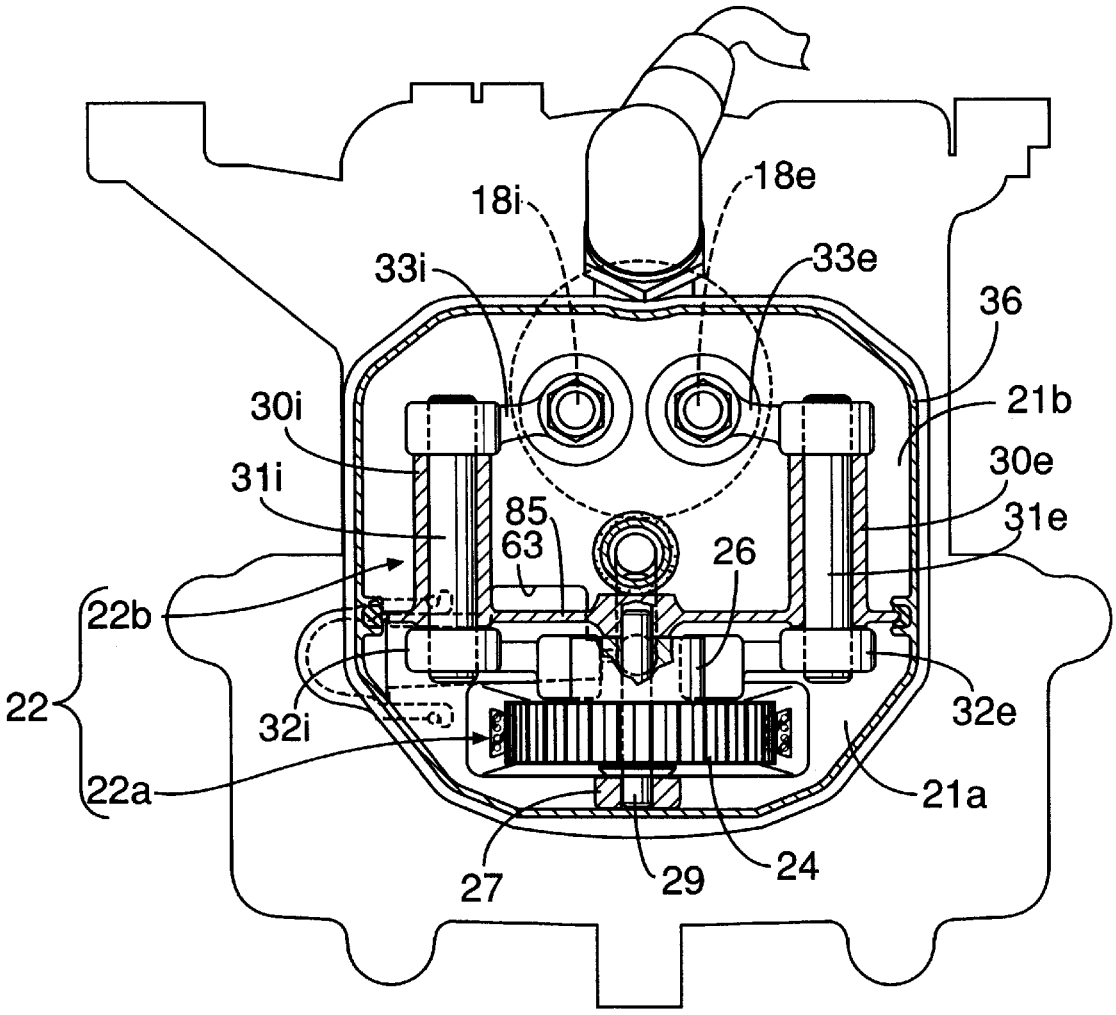
FIG. 7 is a cross-sectional view at line 7—7 in FIG. 4.
Figure 10:
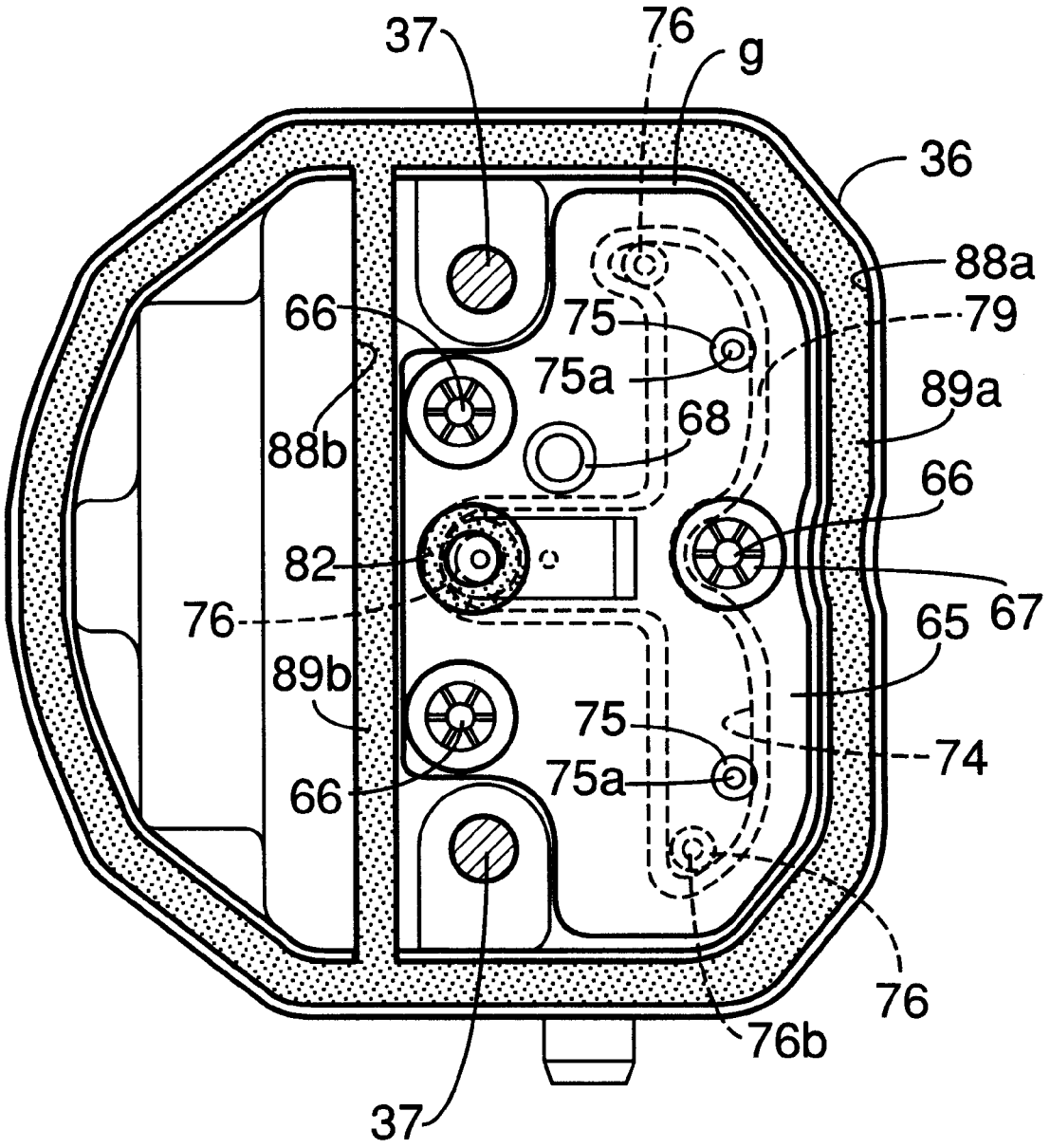
FIG. 10 is a view from line 10—10 in FIG. 5 (bottom view of a head cover).
Figure 11:
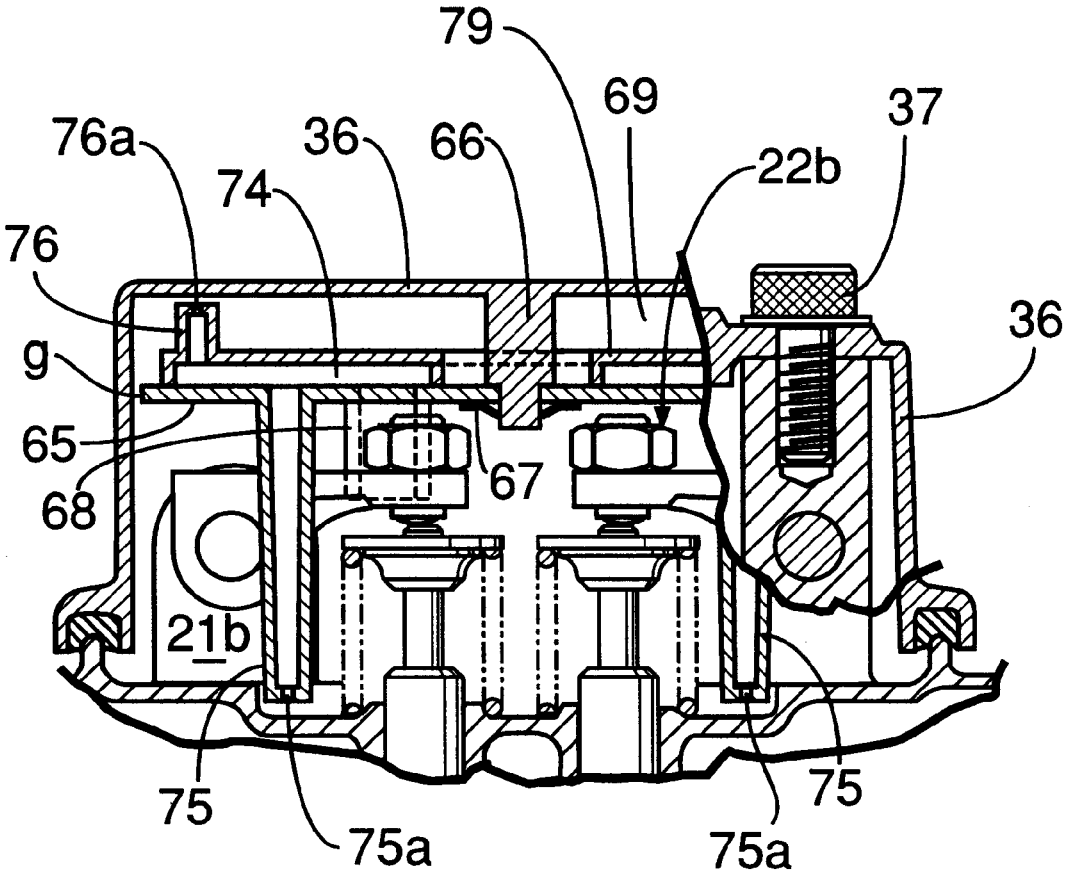
FIG. 11 is a cross-sectional view at line 11—11 in FIG. 5.

As shown in FIGS. 6, 10 and 11, a ring-shaped sealing channel 88*a* corresponding to the above-mentioned sealing bead 87 is formed in the lower end face of a head cover 36, and a linear sealing channel 88*b* providing communication between opposite sides of the ring-shaped channel 88*a* is formed in the inner face of the cover 36. A ring-shaped packing 89*a* is fitted in the ring-shaped sealing channel 88*a*, and a linear packing 89*b* formed integrally with the ring-shaped packing 89*a* is fitted in the linear sealing channel 88*b*. The head cover 36 is joined to the cylinder head 8 by means of a bolt 37 so that the sealing bead 87 and the dividing wall 85 are pressed into contact with the ring-shaped packing 89*a* and the linear packing 89*b* respectively.

The belt guide tube 86 and one half of the head cover 36 define a first valve operation chamber 21*a*, the cylinder head 8 and the other half of the head cover 36 define a second valve operation chamber 21*b*, and the two valve operation chambers 21*a* and 21*b* are divided by the above-mentioned dividing wall 85.

Referring again to FIGS. 2 to 5, the engine main body 1 and the oil tank 40 are divided into an upper block Ba and a lower block Bb on a plane that includes the axis of the crankshaft 13 and is perpendicular to the axis of the cylinder bore 7*a*. That is to say, the upper block Ba integrally includes the upper half of the crankcase 6, the cylinder block 7, the cylinder head 8, the upper half of the oil tank 40 and the belt guide tube 86. The lower block Bb integrally includes the lower half of the crankcase 6 and the lower half of the oil tank 40. These upper and lower blocks Ba and Bb are cast individually, and joined to each other by means of a plurality of bolts 12 (see FIG. 4) after each part has been machined.

Provided in the cylinder head 8 so as to be parallel to the axis of the cylinder bore 7*a* are an intake valve 18*i* and an exhaust valve 18*e* for opening and closing the intake port 9 and the exhaust port 10 respectively, and a spark plug 20 is screwed into the cylinder head 8 so that the electrodes thereof are close to the central area of the combustion chamber 8*a*.

A valve operation mechanism 22 for opening and closing the above-mentioned intake valve 18*i* and exhaust valve 18*e* is explained below by reference to FIGS. 3 to 7.

The valve operation mechanism 22 includes a timing transmission 22*a*, which runs from the interior of the oil tank 40 to the first valve operation chamber 21*a*, and a cam system 22*b*, which runs from the first valve operation chamber 21*a* to the second valve operation chamber 21*b*.

The timing transmission 22*a* includes a drive pulley 23 fixed to the crankshaft 13 within the oil tank 40, a driven pulley 24 rotatably supported in the upper part of the belt guide tube 86, and a timing belt 25 wrapped around these drive and driven pulleys 23 and 24. The end face of the driven pulley 24 on the dividing wall 85 side is joined integrally to a cam 26 forming part of the cam system 22*b*. The drive and driven pulleys 23 and 24 are toothed, and the drive pulley 23 drives the driven pulley 24 via the belt 25 with a reduction ratio of 1/2.

A support wall 27 is formed integrally with the outside wall of the belt guide tube 86, the support wall 27 rising inside the ring-shaped sealing bead 87 and being in contact with or in the vicinity of the inner face of the head cover 36. A through hole 28*a* and a bottomed hole 28*b* are provided in the support wall 27 and the dividing wall 85 respectively. Opposite ends of a support shaft 29 are rotatably supported by the through hole 28*a* and the bottomed hole 28*b*, and the above-mentioned driven pulley 24 and the cam 26 are rotatably supported on the middle part of the support shaft 29. The support shaft 29 is inserted from the through hole 28*a* into a shaft hole 35 of the driven pulley 24 and the cam 26 and the bottomed hole 28*b* before the head cover 36 is attached. By joining the head cover 36 to the cylinder head 8 and the belt guide tube 86 subsequent to the insertion, the inner face of the head cover 36 sits opposite the outer end of the support shaft 29 thereby preventing the shaft 29 from falling out.

Formed integrally with the dividing wall 85 on the second valve operation chamber 21*b* side are a pair of bearing bosses 30*i* and 30*e* projecting parallel to the support shaft 29. The cam system 22*b* includes the above-mentioned cam 26, an intake rocker shaft 31*i* and an exhaust rocker shaft 31*e* rotatably supported in the above-mentioned bearing bosses 30*i* and 30*e* respectively, an intake cam follower 32*i* and an exhaust cam follower 32*e* fixed to one end of the rocker shafts 31*i* and 31*e* respectively within the first valve operation chamber 21*a*, the extremity of each of the intake cam follower 32*i* and the exhaust cam follower 32*e* being in sliding contact with the lower face of the cam 26, an intake rocker arm 33*i* and an exhaust rocker arm 33*e* fixed to the other end of the intake and exhaust rocker shafts 31*i* and 31*e* respectively within the second valve operation chamber 21*b*, the extremity of each of the intake rocker arm 33*i* and the exhaust rocker arm 33*e* being in contact with the upper end of the intake valve 18*i* and exhaust valve 18*e* respectively, and an intake spring 34*i* and an exhaust spring 34*e* mounted on the intake valve 18*i* and the exhaust valve 18*e* respectively and forcing them in the closed direction.

When the crankshaft 13 rotates, the drive pulley 23 rotating together with the crankshaft 13 rotates the driven pulley 24 and the cam 26 via the belt 25, the cam 26 then rocks the intake and exhaust cam followers 32*i* and 32*e* with appropriate timing, the rocking movements are transmitted to the intake and exhaust rocker arms 33*i* and 33*e* via the corresponding rocker shafts 31*i* and 31*e*, and the intake and exhaust rocker arms 33*i* and 33*e* so rocked can open and close the intake and exhaust valves 18*i* and 18*e* with appropriate timing while co-operatively working with the intake and exhaust springs 34*i* and 34*e*.

In the timing transmission 22*a*, since the driven pulley 24 and the cam 26 are rotatably supported by the support shaft 29 and the support shaft 29 is also rotatably supported in opposite side walls of the first valve operation chamber 21*a*, the support shaft 29 rotates due to frictional drag during rotation of the driven pulley 24 and the cam 26, the difference in rotational rate between the support shaft 29 and the driven pulley 24 and the cam 26 decreases and abrasion of the rotating and sliding areas can be suppressed, thus contributing to an improvement in the durability.

The lubrication system of the above-mentioned engine E is now explained by reference to FIGS. 3 to 12.

Figure 4:
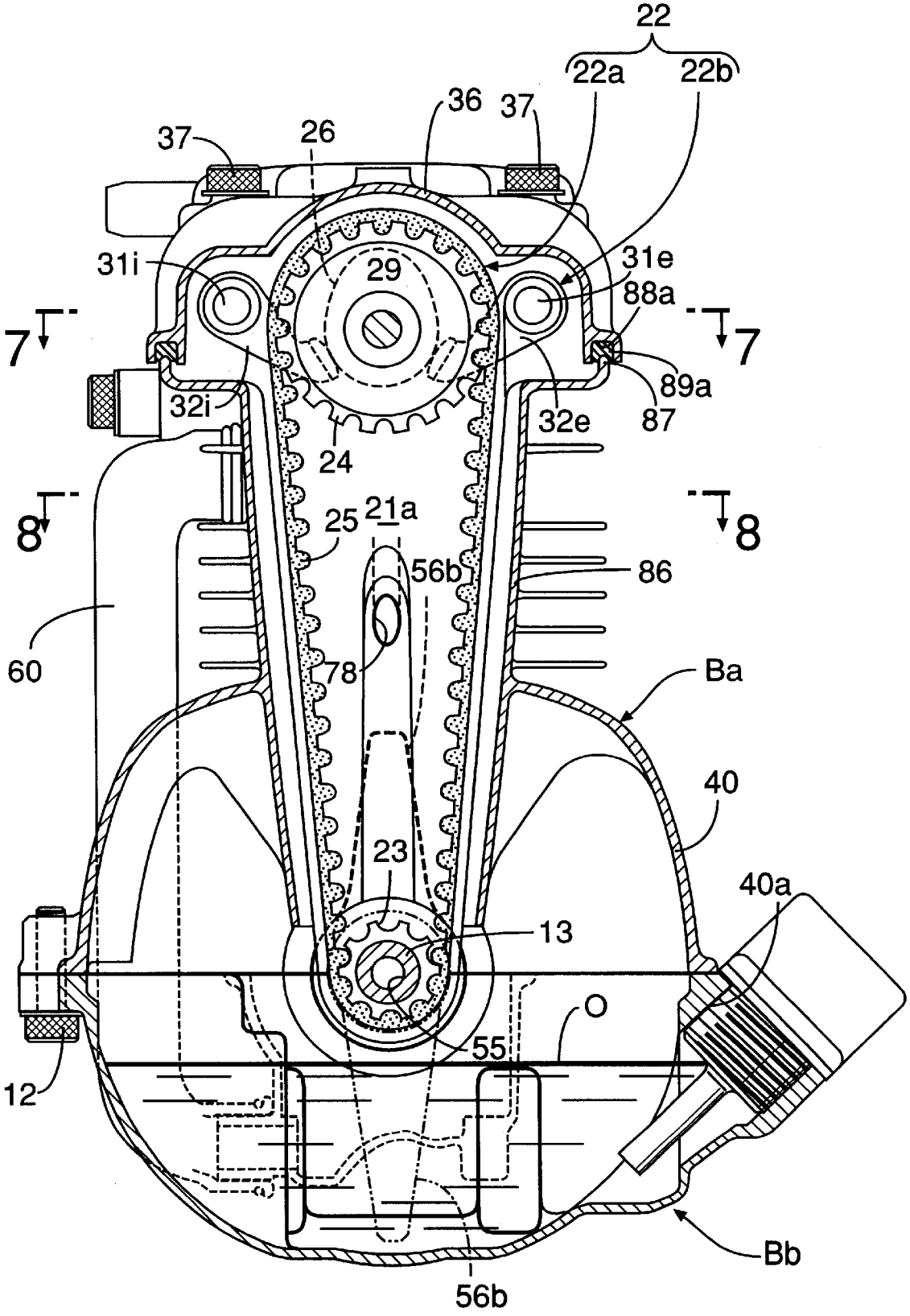
FIG. 4 is a cross-sectional view at line 4—4 in FIG. 2.
Figure 5:
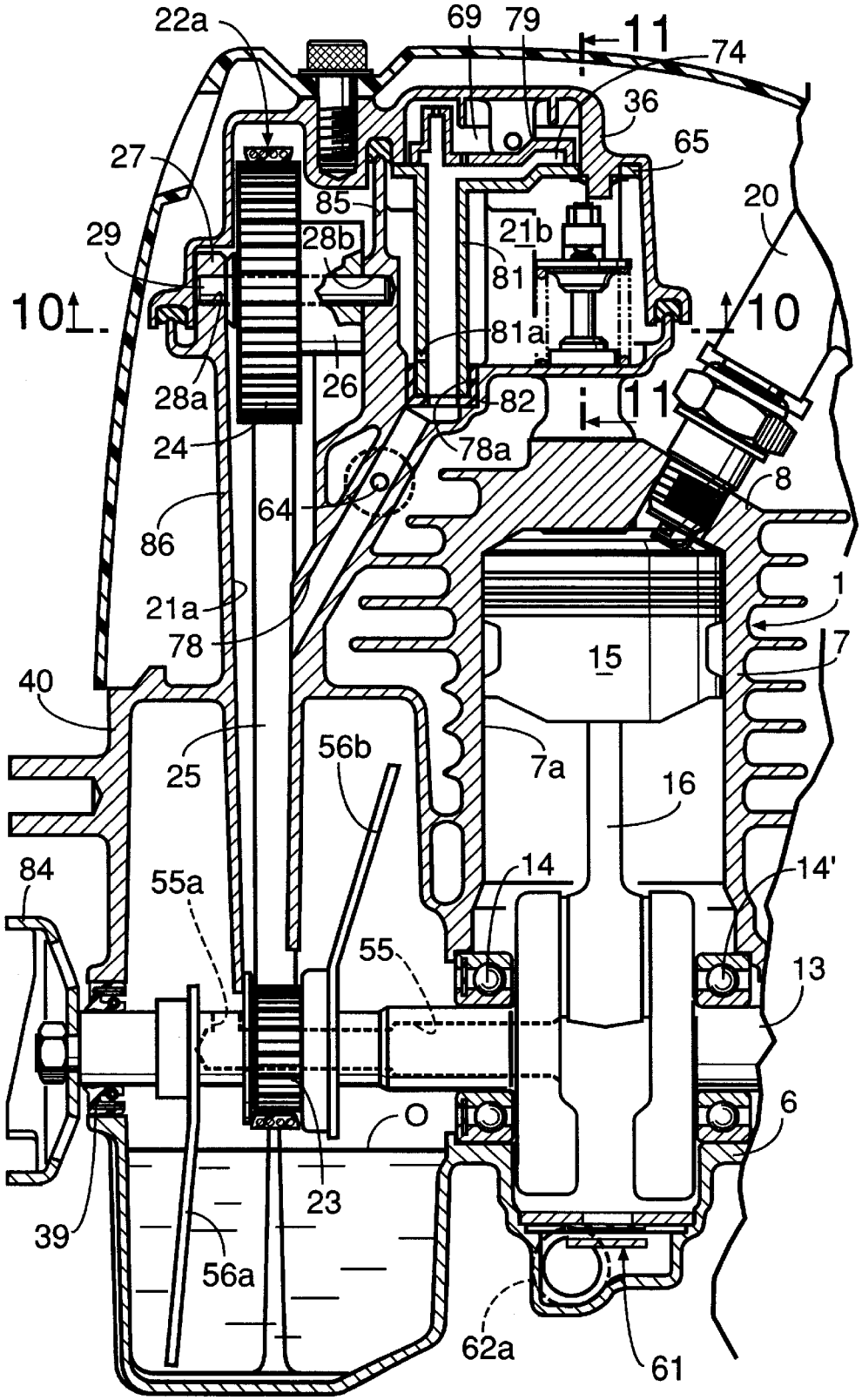
FIG. 5 is a magnified view of an essential part of FIG. 2.

As shown in FIGS. 4 and 5, the oil tank 40 stores a predetermined amount of lubricating oil O poured in through an oil inlet 40*a*. Within the oil tank 40, a pair of oil slingers 56*a* and 56*b* arranged on either side of the drive pulley 23 in the axial direction are press-fitted, etc. onto the crankshaft 13. These oil slingers 56*a* and 56*b* extend in directions radially opposite to each other and the extremities thereof are bent so as to move away from each other in the axial direction so that when the oil slingers 56*a* and 56*b* are rotated by the crankshaft 13 at least one of the oil slingers 56*a* and 56*b* stirs and scatters the oil O stored within the oil tank 40, thereby generating an oil mist regardless of the operational position of the engine E. In this case, the oil mist becomes attached to the part of the timing transmission 22*a* that extends within the oil tank 40 from the first valve operation chamber 21*a*, or the oil mist enters the first valve operation chamber 21*a*, and the timing transmission 22*a* can thus be lubricated directly, which provides one lubrication system.

Another lubrication system includes, as shown in FIGS. 3 to 5 and 12, a through hole 55 provided in the crankshaft 13 so as to provide communication between the interior of the oil tank 40 and the crank chamber 6*a*, an oil feed pipe 60 disposed outside the engine main body 1 so as to connect the lower part of the crank chamber 6*a* to the lower part of the second valve operation chamber 21*b*, an oil recovery chamber 74 provided in the cylinder head 8 in order to draw up oil liquefied and resided in the second valve operation chamber 21*b*, an oil return passage 78 formed between the cylinder head 8 and the oil tank 40 so as to provide communication between the oil recovery chamber 74 and the oil tank 40 via the first valve operation chamber 21*a*, and a one-way valve 61 provided in the lower part of the crank chamber 6*a* and allowing the flow of oil mist only in the direction from the crank chamber 6*a* to the oil feed pipe 60.

An open end 55*a* of the above-mentioned through hole 55 within the oil tank 40 is positioned in the central part or the vicinity thereof within the oil tank 40 so that the open end 55*a* is always above the liquid level of the oil O within the oil tank 40 regardless of the operational position of the engine E. The drive pulley 23 and one of the oil slingers 56*a* are fixed to the crankshaft 13 with the open end 55*a* therebetween so that it is not blocked.

The above-mentioned one-way valve 61 (see FIG. 3) is formed from a reed valve in the illustrated embodiment; it closes when the pressure of the crank chamber 6*a* becomes negative and opens when the pressure becomes positive accompanying the reciprocating motion of the piston 15.

Figure 8:
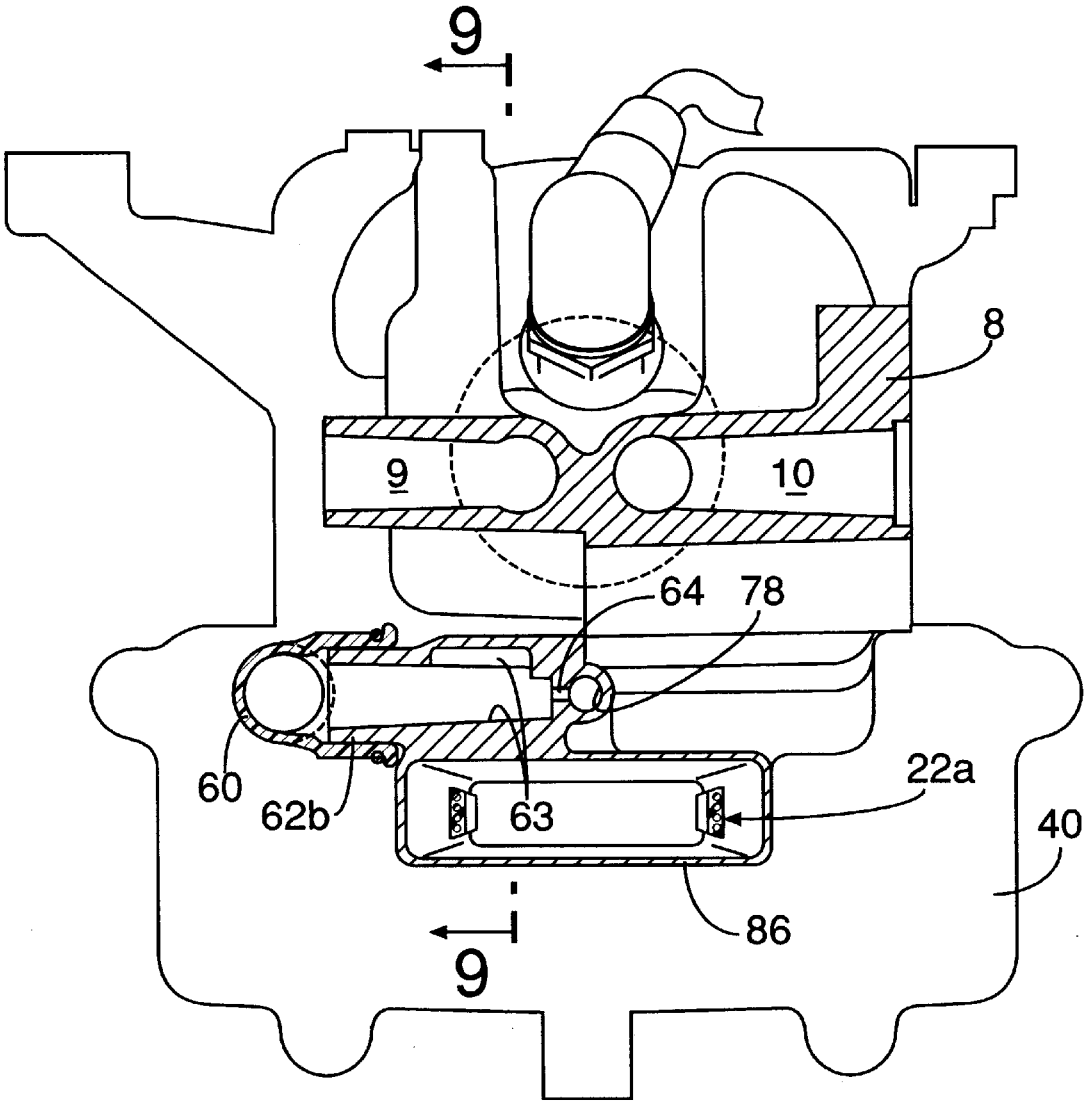
FIG. 8 is a cross-sectional view at line 8—8 in FIG. 4.
Figure 9:
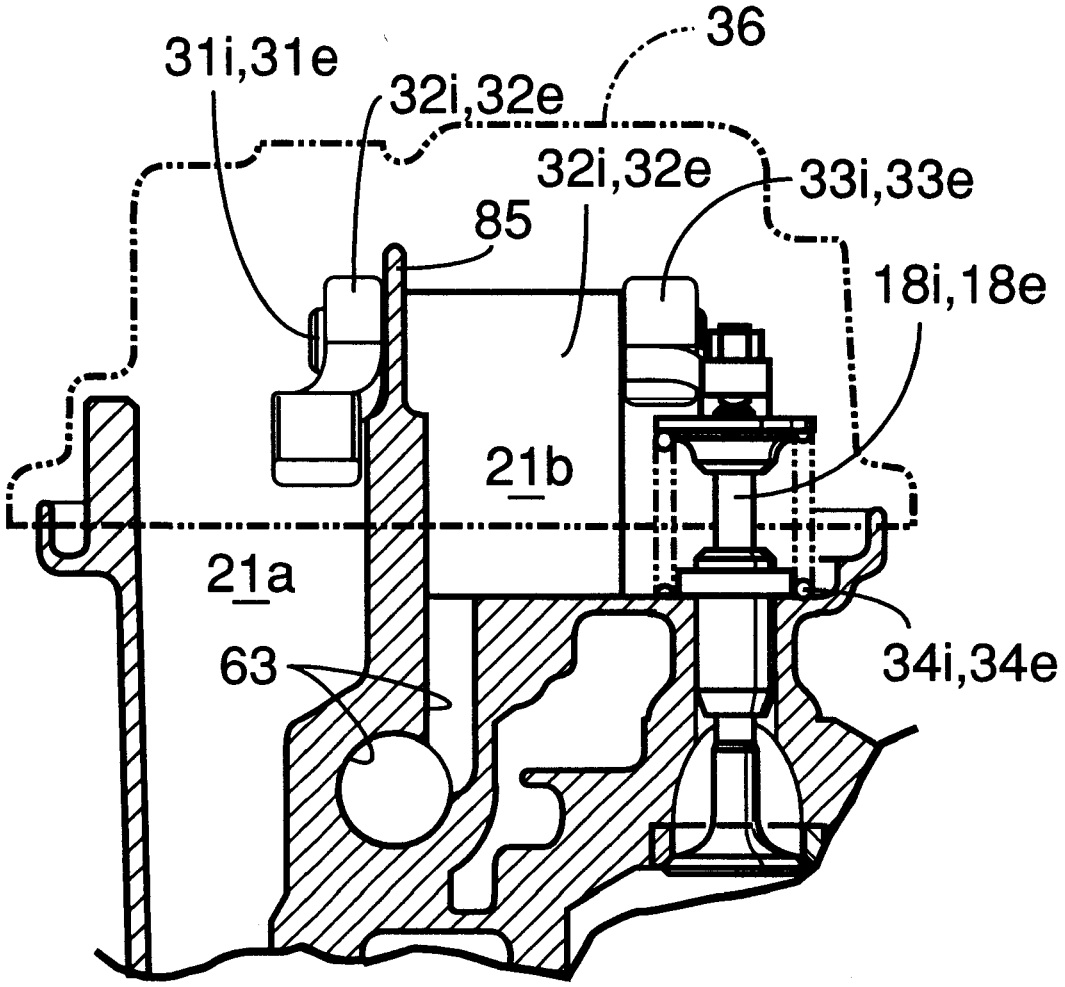
FIG. 9 is a cross-sectional view at line 9—9 in FIG. 8.

The lower end of the oil feed pipe 60 is connected by fitting it onto a lower connection pipe 62*a* projectingly provided on the outside face of the crankcase 6 (see FIG. 3) and the upper end of the oil feel pipe 60 is connected by fitting it onto an upper connection pipe 62*b* projectingly provided on the outside face of the cylinder head 8 (see FIGS. 4 and 8). The interior of the upper connection pipe 62*b* communicates on the one hand with the lower part of the second valve operation chamber 21*b* via a communicating passage 63 (see FIGS. 8 and 9) formed in the cylinder head 8 and having large dimensions, and on the other hand with the oil return passage 78 via an orifice-like bypass 64 (see FIG. 8).

As shown in FIGS. 5, 10 and 11, a partition plate 65 defining a breather chamber 69 in the upper part within the head cover 36 is fitted to the roof of the head cover 36 by means of a plurality of stays 66 and clips 67 fastened to the stays 66, the stays 66 being projectingly provided on the roof. The breather chamber 69 communicates on the one hand with the second valve operation chamber 21*b* via a communicating pipe 68 and a gap g between the inner face of the head cover 36 and the partition plate 65, the communicating pipe 68, which has large dimensions, being formed integrally with the partition plate 65 and projecting toward the second valve operation chamber 21*b*, and on the other hand with the interior of the above-mentioned air cleaner 4 via a breather pipe 70. In the breather chamber 69 a mixture of oil and blowby gas is separated into gas and liquid, and a labyrinth wall 72 for promoting the gas-liquid separation is projectingly provided on the inner face of the roof of the head cover 36.

The upper surface of the partition plate 65 is welded to a box-shaped partition body 79, having one open face and being T-shaped in plan view, so as to define the above-mentioned oil recovery chamber 74 therebetween, the oil recovery chamber 74 therefore also being T-shaped.

Integral with the partition plate 65 are projectingly provided two draw-up pipes 75, which respectively communicate with opposite ends of the lateral bar of the T-shaped oil recovery chamber 74. The extremity of each of the draw-up pipes 75 extends toward the vicinity of the base of the second valve operation chamber 21*b*, and an opening in the extremity of each of the draw-up pipes 75 forms an orifice 75*a*.

Integral with the upper wall of the partition body 79 are projectingly provided three draw-up pipes 76, which communicate with three positions corresponding to the extremities of the lateral and vertical bars of the T-shape of the oil recovery chamber 74. Each of the extremities of these draw-up pipes 76 extends toward the vicinity of the roof of the breather chamber 69, and an opening in the extremity of each of the draw-up pipes 76 forms an orifice 76*a*.

Furthermore, in the upper wall of the partition body 79 is provided an orifice 80, providing communication between an indentation 79*a* in the upper face of the partition body 79 and the oil recovery chamber 74.

Moreover, integral with the partition plate 65 is projectingly provided one pipe 81 communicating with a region corresponding to the extremity of the vertical bar of the T-shape of the oil recovery chamber 74. The extremity of the pipe 81 is fitted into an inlet 78*a* of the above-mentioned oil return passage 78 via a grommet 82, the inlet 78*a* opening onto the base of the second valve operation chamber 21*b*. The oil recovery chamber 74 is thereby connected to the oil return passage 78. The above-mentioned pipe 81 is placed close to an inner side face of the second valve operation chamber 21*b*, and an orifice 81*a* for drawing up oil is provided in the region close to the above-mentioned inner side face, the orifice 81*a* providing communication between the second valve operation chamber 21*b* and the interior of the pipe 81.

Since the breather chamber 69 communicates with the interior of the air cleaner 4 via the breather pipe 70, the pressure of the breather chamber 69 is maintained at substantially atmospheric pressure even during operation of the engine E, and the pressure of the second valve operation chamber 21*b* communicating with the breather chamber 69 via the communicating pipe 68, which has a low flow resistance, is substantially the same as that of the breather chamber 69.

Since the crank chamber 6*a* discharges only the positive pressure component of the pressure pulsations caused by the ascending and descending motion of the piston 15 into the oil feed pipe 60 through the one-way valve 61 during operation of the engine E, the pressure of the crank chamber 6*a* is negative on average, and since the second valve operation chamber 21*b* receiving the above-mentioned positive pressure communicates with the breather chamber 69 via the communicating pipe 68 having a small flow resistance, the pressure of the second valve operation chamber 21*b* is substantially the same as that of the breather chamber 69. Since the negative pressure of the crank chamber 6*a* is transmitted to the oil tank 40 via the through hole 55 of the crankshaft 13 and further to the oil recovery chamber 74 via the oil return passage 78, the pressure of the oil recovery chamber 74 is lower than those of the second valve operation chamber 21*b* and the breather chamber 69, and the pressures of the oil tank 40 and the first valve operation chamber 21*a* are lower than that of the oil recovery chamber 74.

Figure 12:
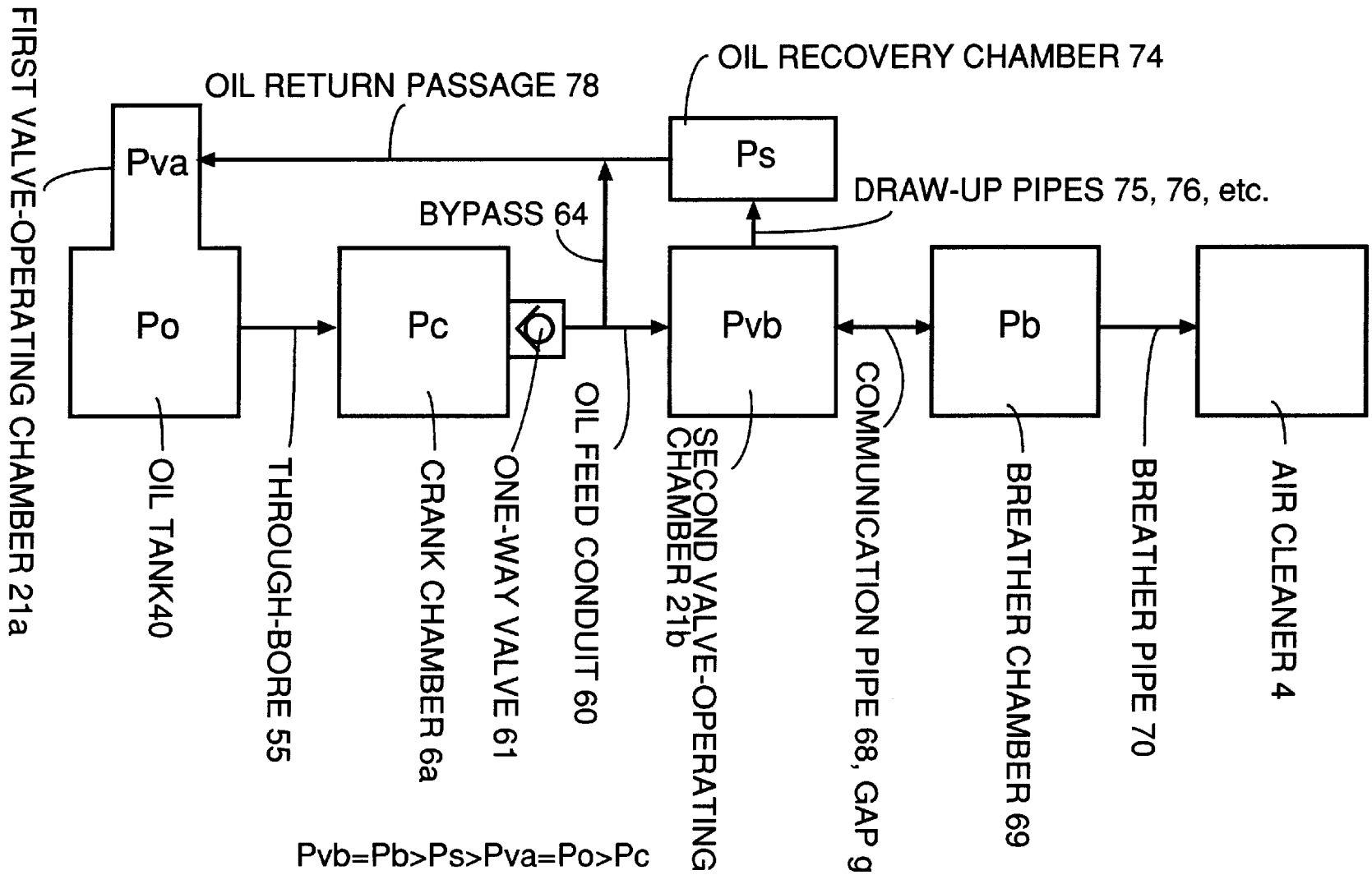
FIG. 12 is a diagram showing a lubrication route of the above-mentioned engine.

As shown in FIG. 12, if the pressure of the crank chamber 6*a* is denoted by Pc, the pressure of the oil tank 40 is denoted by Po, the pressure of the first valve operation chamber 21*a* is denoted by Pva, the pressure of the second valve operation chamber 21*b* is denoted by Pvb, the pressure of the oil recovery chamber 74 is denoted by Ps, and the pressure of the breather chamber 69 is denoted by Pb, the following relationship is therefore satisfied.

$$Pvb=Pb>Ps>Po=Pva>Pc$$

As a result, the pressure of the second valve operation chamber 21*b* and the breather chamber 69 is transferred to the oil recovery chamber 74 via the draw-up pipes 75 and 76 and the orifice 80, further to the oil tank 40 via the oil return passage 78 and then to the crank chamber 6*a*.

During operation of the engine E, oil mist is generated by the oil slingers 56*a* and 56*b* stirring and scattering the lubricating oil O within the oil tank 40, the oil slingers 56*a* and 56*b* being rotated by the crankshaft 13. As hereinbefore described, the oil droplets so generated is splashed over the part of the timing transmission 22*a* exposed within the oil tank 40 from the belt guide tube 86, that is to say, the drive pulley 23 and part of the timing belt 25, or the oil droplets enter the first valve operation chamber 21*a*, and the timing transmission 22*a* is thus lubricated directly.

The oil mist generated in the oil tank 40 is drawn into the crank chamber 6*a* via the through hole 55 of the crankshaft 13 along the direction of the abovementioned pressure flow, thereby lubricating the area around the crankshaft 13 and the piston 15. When the pressure of the crank chamber 6*a* becomes positive due to the piston 15 descending, the one-way valve 61 opens and the above-mentioned oil mist together with the blowby gas generated in the crank chamber 6*a* ascend through the oil feed pipe 60 and the communicating passage 63 and are supplied to the second valve operation chamber 21*b*, thereby lubricating each part of the cam system 22*b* within the chamber 21*b*, that is to say, the intake and exhaust rocker arms 33*i* and 33*e*, etc.

In this case, a portion of the oil mist passing through the abovementioned communicating passage 63 is shunted to the oil return passage 78 via the orifice-like bypass 64. It is therefore possible to control the amount of oil mist supplied to the second valve operation chamber 21*b* by setting the flow resistance of the bypass 64 appropriately.

The oil mist and the blowby gas within the second valve operation chamber 21*b* are separated into gas and liquid by expansion and collision with the labyrinth wall 72 while being transferred to the breather chamber 69 through the communicating pipe 68 and the gap g around the partition plate 65, and the blowby gas is taken into the engine E via the breather pipe 70 and the air cleaner 4 in that order during the intake stroke of the engine E.

When the engine E is in an upright state, since the oil liquefied in the breather chamber 69 resides in the indentation 79*a* in the upper face of the partition body 79 or flows down the communicating pipe 68 or through the gap g and is resided on the base of the second valve operation chamber 21*b*, in that case the oil is drawn up by means of the orifice 80 or the drawn-up pipe 75 provided in those places into the oil recovery chamber 74. When the engine E is in an upside down state, since the above-mentioned liquefied oil resides on the roof of the head cover 36, in that case the oil is drawn up by means of the draw-up pipe 76 provided there into the oil recovery chamber 74.

The oil thus drawn up into the oil recovery chamber 74 returns from the pipe 81 into the oil tank 40 via the oil return passage 78. In this case, when the oil return passage 78 communicates with the oil tank 40 via the first valve operation chamber 21*a* as in the illustrated embodiment, the oil discharged from the oil return passage 78 is splashed over the timing transmission 22*a*, thereby advantageously lubricating it.

Since the roof of the head cover 36 and the partition plate 65 attached to the inner wall of the head cover 36 define the above-mentioned breather chamber 69 therebetween and the upper face of the above-mentioned partition plate 65 and the partition body 79 welded to the partition plate 65 define the above-mentioned oil recovery chamber 74 therebetween, the oil recovery chamber 74 and the breather chamber 69 can be provided in the head cover 36 without splitting the roof of the head cover 36. Moreover, since the breather chamber 69 and the oil recovery chamber 74 are present within the head cover 36, even if some oil leaks from either of the chambers 69 and 74, the oil simply returns to the second valve operation chamber 21*b* without causing any problems, it is unnecessary to inspect the peripheries of the two chambers 69 and 74 for oil tightness and the production cost can thus be reduced.

Since the partition body 79 can be welded to the partition plate 65 before attaching the partition plate 65 to the head cover 36, the oil recovery chamber 74 can easily be formed using the partition plate 65.

Furthermore, since the oil draw-up pipes 75 and 76 are formed integrally with the partition plate 65 and the partition body 79 respectively, the oil draw-up pipes 75 and 76 can easily be formed.

Figure 13:
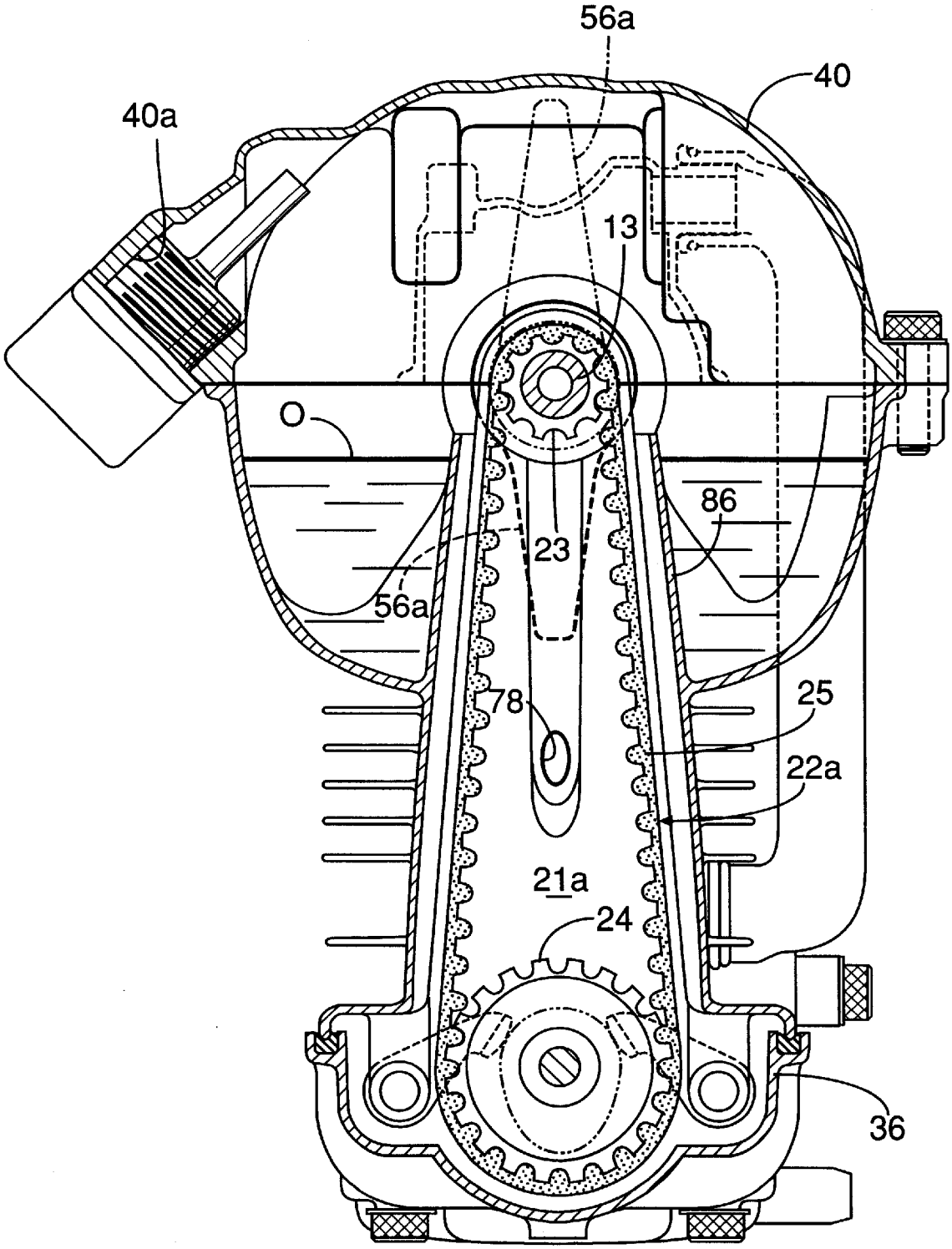
FIG. 13 is a view corresponding to FIG. 4 in which the above-mentioned engine is in an upside down state.

When the engine E is in an upside down state as shown in FIG. 13, the oil O stored in the oil tank 40 moves toward the roof of the tank 40, that is to say, the first valve operation chamber 21*a* side. Since the open end of the first valve operation chamber 21*a* within the oil tank 40 is set so as to be at a higher level than the liquid level of the stored oil O by means of the belt guide tube 86, the stored oil O is prevented from entering the first valve operation chamber 21*a*, thereby preventing excess oil from being supplied to the timing transmission 22*a*, and it is also possible to maintain a predetermined amount of oil within the oil tank 40, thus allowing the oil slingers 56*a* and 56*b* to continuously generate an oil mist.

Figure 14:
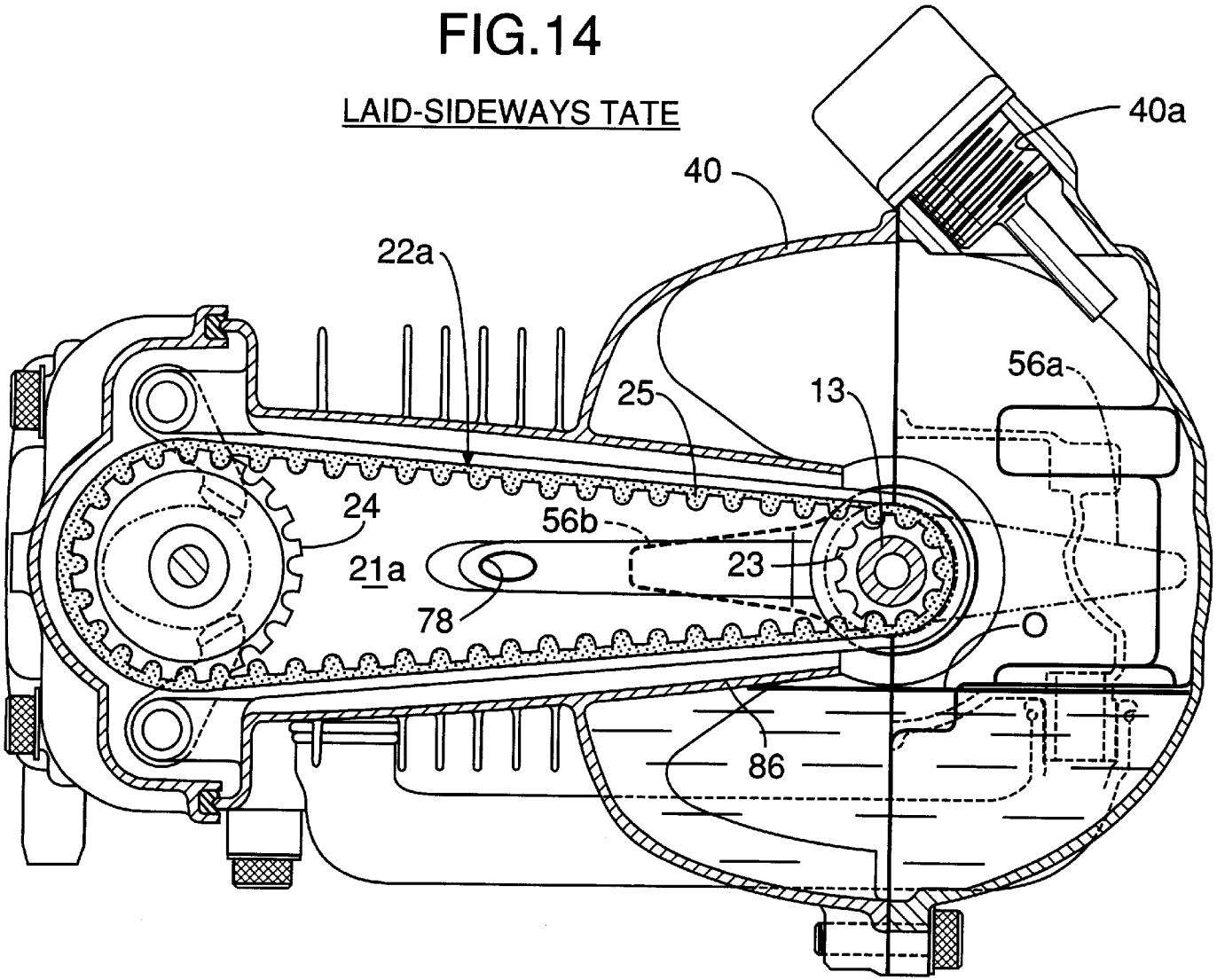
FIG. 14 is a view corresponding to FIG. 4 in which the above-mentioned engine is in a laid-sideways state.

When the engine E is laid sideways during its operation as shown in FIG. 14, the stored oil O moves toward the side face of the oil tank 40, and, in this case also, since the open end of the first valve operation chamber 21*a* within the oil tank 40 is set so as to be at a higher level than the liquid level of the stored oil O by means of the belt guide tube 86, the stored oil O is prevented from entering the first valve operation chamber 21*a* and it is possible to prevent excess oil from being supplied to the timing transmission 22*a* and also to maintain a predetermined amount of oil within the oil tank 40, thus allowing the oil slingers 56*a* and 56*b* to continuously generate an oil mist.

The lubrication system for the valve operation mechanism 22 can thus be divided into a system for lubricating part of the cam system 22*b* and the timing transmission 22*a* within the first valve operation chamber 21*a* and the oil tank 40 with the oil scattered within the oil tank 40, and a system for lubricating the remainder of the cam system 22*b* within the second valve operation chamber 21*b* with the oil mist transferred to the second valve operation chamber 21*b*. The load put on each of the lubrication systems can thus be reduced and the entire valve operation mechanism 22 can be lubricated thoroughly. Moreover, each part of the engine E can be lubricated reliably by the use of oil droplets and oil mist regardless of the operational position of the engine E.

Since the oil mist generated within the oil tank 40 is returned by utilizing the pressure pulsations within the crank chamber 6*a* and the one-way transfer function of the one-way valve 61, it is unnecessary to employ a special oil pump for circulating the oil mist and the structure can be simplified.

Furthermore, not only the oil tank 40 but also the oil feed pipe 60 providing communication between the crank chamber 6*a* and the second valve operation chamber 21*b* are disposed outside the engine main body 1, which does not prevent making the engine main body 1 thinner and more compact, greatly contributing to reduction in the weight of the engine E. In particular, since the externally placed oil feed pipe 60 is little influenced by the heat of the engine main body 1 and easily releases its heat, cooling of the oil mist passing through the oil feed pipe 60 can be promoted.

Furthermore, since the oil tank 40 is placed on one side of the exterior of the engine main body 1, the total height of the engine E can be greatly reduced, and since part of the timing transmission 22*a* is housed in the oil tank 40, any increase in the width of the engine E can be minimized, thus making the engine E more compact.

The number of oil draw-up pipes 75 and 76 and orifices 80 and 81*a* for drawing up oil and the positions in which they are placed can be chosen freely. Furthermore, the partition body 79 can be welded to the lower face of the partition plate 65, thereby forming the oil recovery chamber 74 below the partition plate 65. In this case, the oil draw-up pipe 75 is formed integrally with the partition body 79 and the oil draw-up pipe 76 is formed integrally with the partition plate 65.

Moreover, instead of the one way valve 61, a rotary valve can be provided, the rotary valve being operable in association with the crankshaft 13 and operating so as to open the oil feed pipe 60 when the piston 15 descends and block the oil feed pipe 60 when the piston 15 ascends.

The present invention is not limited to the above-mentioned embodiment and can be modified in a variety of ways without departing from the spirit and scope of the invention.

What is claimed is:

1. An engine head cover structure having a head cover joined to the upper end of a cylinder head so as to define a valve operation chamber therebetween, the head cover including therein an oil recovery chamber to which oil resided in the valve operation chamber is recovered by suction and a breather chamber that removes blowby gas from the valve operation chamber, wherein the breather chamber is defined between a partition plate mounted on an inner wall of the head cover and an inner surface of the roof of the head cover, and the oil recovery chamber is formed between the partition plate and a box-shaped partition body mounted on the partition plate.

2. The engine head cover structure according to claim 1, wherein the oil recovery chamber is defined between the surface of one of opposite sides of the partition plate and said partition body welded thereto.

3. The engine head cover structure according to claim 2, wherein a first oil draw-up pipe that opens in the vicinity of the base of the valve operation chamber while communicating with the oil recovery chamber is formed integrally with one of the partition plate and the partition body, and a second oil draw-up pipe that opens in the vicinity of the roof of the head cover while communicating with the oil recovery chamber is formed integrally with the other one of the partition plate and the partition body.

4. The engine head cover structure according to claim 1, wherein a gap is defined between the inner surface of the roof of the head cover and an outer periphery of the partition plate for providing connection between the breather chamber and the valve operation chamber.

* * * * *